United States Patent [19]

Shalashov et al.

[11] 4,383,581

[45] May 17, 1983

[54] TOOL FOR DRILLING BOREHOLES

[76] Inventors: Jury F. Shalashov, ulitsa Omskaya, 61, kv. 10; Vladimir D. Butkin, ulitsa Klary Tsetkin, 30"A", kv. 77, both of Chelyabinsk; Vadim D. Petukhov, ulitsa Russkaya, 25, kv. 197, Novosibirsk, all of U.S.S.R.

[21] Appl. No.: 244,201

[22] Filed: Mar. 16, 1981

[51] Int. Cl.[3] ..... E21C 3/20; E21C 3/24

[52] U.S. Cl. ..... 173/16; 91/234; 175/92

[58] Field of Search ..... 91/234; 175/92; 173/2, 173/12, 13, 15–17, 134

[56] References Cited

U.S. PATENT DOCUMENTS

| | | | |
|---|---|---|---|
| 3,216,510 | 11/1965 | Briden | 173/15 |
| 3,446,291 | 5/1969 | Judd et al. | 173/17 |
| 4,305,473 | 12/1981 | Gidlund | 173/16 |

FOREIGN PATENT DOCUMENTS

| | | | |
|---|---|---|---|
| 1394230 | 5/1975 | United Kingdom | 173/16 |

*Primary Examiner*—James G. Smith
*Assistant Examiner*—K. Bradford Adolphson
*Attorney, Agent, or Firm*—Lilling & Greenspan

[57] ABSTRACT

A tool for cutting percussive rotary drilling of boreholes includes a hollow casing having a bit. A hammer piston is installed in the casing for reciprocations and for cooperation with the bit for imparting impact impulses thereto. The hammer piston divides a working space of the casing into a workstroke chamber and a return stroke chamber which are alternately connected through distribution means provided in the casing with a source of a fluid under pressure for reciprocations of the hammer piston. There are provided controlled throttling means in permanent communication with distribution means which can be set to two limit positions, so that in the first position they provide for a partial supply of a fluid for reciprocations of the hammer piston with minimum kinetic energy and in the second position the throttling means are completely closed so as to provide for the full supply of a fluid to the workstroke and return stroke chambers through the distribution means for reciprocations of the hammer piston at maximum kinetic energy. There are provided control means which are coupled to the bit and to the controlled throttling means for setting them to the first position when the bit encounters a soft rock and to the second position when the bit encounters a hard rock.

8 Claims, 5 Drawing Figures

TOOL FOR DRILLING BOREHOLES

BACKGROUND OF THE INVENTION

The present invention relates to drilling machines and, more particularly, to tools for drilling rocks, especially rocks of alternating hardness.

The invention may be most preferably used in the mining industry, preferably at open cut mining for drilling blastholes.

The invention may also be used in the geological practice, in the construction industry and municipal works and other fields where boreholes are to be drilled under complicated geological conditions with non-uniform rock hardness.

At present a problem exists in the drilling technology which is associated with the employment of a single tool for drilling rocks of alternating hardness.

Generally rocks are formed by various alternating layers with a hardness f varying from 1 to 12 by the M. M. Protodyakonov scale, the rocks with a hardness f=1-6 belonging to soft rocks and those with f=6-12 to hard rocks. Interlayers of rocks of various thickness and hardness in depth generally occur without any predetermined regularity. Drilling such rocks by means of conventional machines and bits is associated with certain difficulties and is rather inefficient in a number of applications. All these factors impair technological and economic performance of drilling tools and rigs.

Drilling of complicated rocks with a hardness f=1-12 can be efficient and economically advantageous only in case drilling tools and conditions are adequate for a given type of rock. Rocks with a hardness f=1-6 are preferably drilled with cutting bits and rocks with a hardness f>6 are drilled with cutter-bit and rotary percussive bits. The employment of one type of conventional drilling tools and bits for drilling complicated rocks with f=1-12 or changing tools and bits during borehole drilling depending on hardness of the rock being drilled is economically disadvantageous.

DESCRIPTION OF THE PRIOR ART

Known in the art is a tool for drilling boreholes (cf. Minin et al., USSR Inventor's Certificate No. 136692, Cl. 5a, 27), having a hollow casing accommodating an impact mechanism including a striker rigidly connected with a bit and a distribution arrangement having respective passages and ports connected to a source of a fluid under pressure. The hollow casing provided with an adapter at one end thereof for coupling to a drill rod is connected to claws carrying cutter blocks by means of bolts.

A fluid under pressure fed by means of the distribution arrangement causes the striker to reciprocate together with the bit to impart impact impulses to the borehole bottom through the cutter blocks so as to break down the borehole bottom.

A substantial disadvantage of the above-described tool resides in that the striker is rigidly connected with the bit. This substantially complicates the manufacture of the tool and creates difficulties in changing blunt bits. In addition, such an impact mechanism cannot function in drilling soft rocks.

Known in the art is a tool for drilling boreholes (cf. Melnikov et al., USSR Inventor's Certificate No. 254,426, Cl. 5a, 5/00), having a cylindrical casing in which is freely accommodated an impact mechanism including a distribution arrangement having a striker and associated with a shock-absorbing piston which has passages for feeding a fluid under pressure to the distribution arrangement. To the cylindrical casing which is coupled by means of an adapter to drill rods at one end are rigidly attached a cutter bit and a percussive bit which is axially movable relative to the casing and is rigidly secured for combined rotation. The percussive bit cooperates with the striker through an anvil block.

The striker reciprocates under the action of a fluid under pressure and imparts impact impulses to the percussive bit through the anvil block. An axial force from a drilling rig is transmitted through the cylindrical casing and the body of the cutter bit to the cutter blocks independently of the impact impulses transmitted from the impact mechanism. The borehole bottom is broken down simultaneously by both the axial force and impact loads.

The prior art tool is deficient in that in drilling rocks of alternating hardness with a hardness f=1-12 the interior of the cutter blocks is clogged when interlayers with f=1-6 are drilled, and the pneumatic hammer becomes inoperative owing to an inadequate energy of rebound.

Attempts have been made to solve the problem of using impact mechanisms for drilling in soft and viscous rocks, and one of such solutions involved the employment of a percussive rotary tool (cf. Vasilyev, USSR Inventor's Certificate No. 193,394, Cl. 5a, 14/10) for drilling boreholes. The tool has a casing with an impact mechanism including a striker incorporated a drill rod which is connected to a source of a fluid under pressure, the striker being secured to the drill rod by means of coupling sleeves transmitting a torque to the impact mechanism casing; a spring reducing vibrations at the casing; and a seal sealing off the interior space defined by coupling sleeves and the drill rod. One end of the impact mechanism casing is coupled to said seal and is connected to the source of a fluid under pressure through respective passages of the seal and sleeve. To the other end, which is located at the level of the end face of the drill rod, is attached a bit which is axially movable relative to the casing and is rigidly coupled thereto for combined rotation. To this end of the drill rod is rigidly secured a body of a bit having three percussive and cutting tools which have their inner surfaces engaging, through three two-sided wedges, the outer surface of the bit which is installed in said casing accommodating the impact mechanism.

The drill rod is caused to rotate and is fed to the borehole bottom by a required axial force applied by means of a rotary feed gear of a drilling rig.

Torque is transmitted from the drill rod through the sleeves to the casing accommodating the impact mechanism and, via the bit body, to three percussive cutters secured thereto which break down the borehole bottom by cutting.

A fluid under pressure causes reciprocations of the striker to impart impact impulses to the bit. The bit breaks down the central area of the borehole bottom and also transmits impact impulses to three two-sided wedges which are supported by the body of the percussive and cutting tools to transmit the impact impulses thereto. Therefore, the rock of the borehole bottom is broken down by the percussive and cutting tools under the action of three forces: torque, axial force and impact impulses.

The disadvantage of the above-described rotary percussive drilling tool is in the provision of three two-sided wedges which reduce the power transmitted to the percussive and cutting tools. In addition, when slime gets inbetween the crown body and the front-end surface of the wedges in such an arrangement, the impact impulses are taken-up by the body of the crown having the percussive and cutting tools and lead to destruction of the body. Therefore, the employment of such a tool for drilling rocks of alternating hardness appears to be impossible in view of a loss of operativeness of the tool in drilling soft and viscous interlayers.

It will be therefore apparent that one and the same disadvantage is inherent in conventional tools for drilling boreholes which consists in the fact that the impact mechanism is unsuitable for operation in soft rocks, while the provision of cutter blocks lowers the technological and economic performance of drilling when such tools are used.

SUMMARY OF THE INVENTION

It is an object of the invention to provide a highly efficient tool for drilling in complicated rocks having alternating hardness number ranging from f=1 to f=12.

The invention includes a tool for cutting percussive rotary drilling of boreholes, comprising a hollow casing to which is attached a bit installed for axial movement relative thereto and for positive combined rotation therewith, the casing being internally provided with a partition wall having an opening to divide the interior of the casing into a working space on the bit side and a supply space communicating with a source of a fluid under pressure and, via the opening of the partition wall, with the working space. In the working space is installed a hammer piston for reciprocations and cooperation with the bit to impart impact impulses thereto, the hammer piston dividing the working space into a workstroke chamber and a return stroke chamber alternately communicating, via distribution means provided in the casing and via the supply space, with the source of a fluid under pressure for causing reciprocations of the hammer piston. According to the invention, there are provided controlled throttling means in permanent communication with the distribution means which can be set to two limit positions, so that in the first position the controlled throttling means establish a permanent communication of the supply space with atmosphere so as to provide for reciprocations of the manner piston with minimum kinetic energy, and in the second position the throttling means are completely closed to provide for the full supply of a fluid to the workstroke and return stroke chambers through the distribution means with maximum kinetic energy. There are also provided control means coupled to the bit and to the controlled throttling means for setting the throttling means to the first position when the bit encounters a soft rock and to the second position when the bit encounters a hard rock.

This arrangement of the tool makes it possible to redistribute the kinetic energy of the hammer piston depending on hardness of the rock and to drill boreholes in rocks of alternating hardness index under optimum conditions.

The controlled throttling means are preferably accommodated in the casing.

This arrangement makes it possible to simplify the design of the tool for cutting percussive rotary drilling of boreholes and to reduce the tool size.

The hammer piston is preferably made with a distribution space in permanent communication with the workstroke chamber, and the controlled throttling means are in permanent communication with the distribution space so that in the first limit position the controlled throttling means permanently connect the supply space with atmosphere and in the second position they are completely closed so as to provide for the full supply of a fluid to the workstroke and return stroke chambers through the distribution space.

This arrangement of the hammer piston in a tool for cutting percussive rotary drilling of boreholes makes it possible to simplify the re-distribution of a fluid for causing reciprocations of the hammer piston.

The distribution means are preferably provided in the form of passages of the hammer piston which connect the distribution space with the workstroke chamber and the return stroke chamber with the supply space; and, the hammer piston preferably has a port in which terminates the passage connecting the return stroke chamber to the supply space. The controlled throttling means comprise a pipe having one end received in the opening of the partition wall, the other end of the pipe extending in a sealing relationship through the hammer piston port into the distribution space so that the hammer piston is movable along the pipe. A slide valve member is installed in the pipe for moving relative thereto and defining with the pipe a throttling orifice, the size of the orifice changing depending on the amount of the relative movement of the slide valve member. The pipe has openings for alternately connecting the return stroke chamber to the source of a fluid through the hammer piston passages during reciprocations of the hammer piston.

This arrangement of the distribution means and of the controlled throttling means makes it possible to provide for reciprocations of the hammer piston and control of kinetic energy of its movment in the most simple way.

The throttling orifice is preferably formed by passages made in the outer surface of the slide valve member which are closed on the supply space side.

This arrangement simplifies the design of the controlled throttling means.

The control means preferably comprise elastic means coupled to the controlled throttling means for controlling them to an extent depending on the axial compression of the elastic means.

This construction of the control means makes it possible to provide for a rapid reaction to changes in the drilling conditions and ensures an automatic control of the throttling means depending on rock hardness.

The elastic means are preferably provided in the supply space and are coupled to the controlled throttling means by means of a rod installed in the pipe.

This arrangement of the elastic means in the tool for cutting rotary percussive drilling provides for a simple and reliable coupling of the elastic means to the slide valve member of the controlled throttling means.

The elastic means preferably comprise a cylinder having opposite transverse grooves provided in its body and extending over the entire length thereof.

This construction of the elastic means ensures the design reliability which enables a resistance to great static and dynamic loads under rather large changes in linear dimensions with small size.

BRIEF DESCRIPTION OF THE DRAWINGS

The invention will now be described in detail with reference to a specific embodiment illustrated in the accompanying drawings, in which.

DETAILED DESCRIPTION OF THE INVENTION

Specific narrow terminology is used in describing the embodiment of the invention illustrated in the accompanying drawings. It should be, however, understood that each such term englobes all equivalent elements functioning in similar manner and used for the same purpose.

Figure 1:
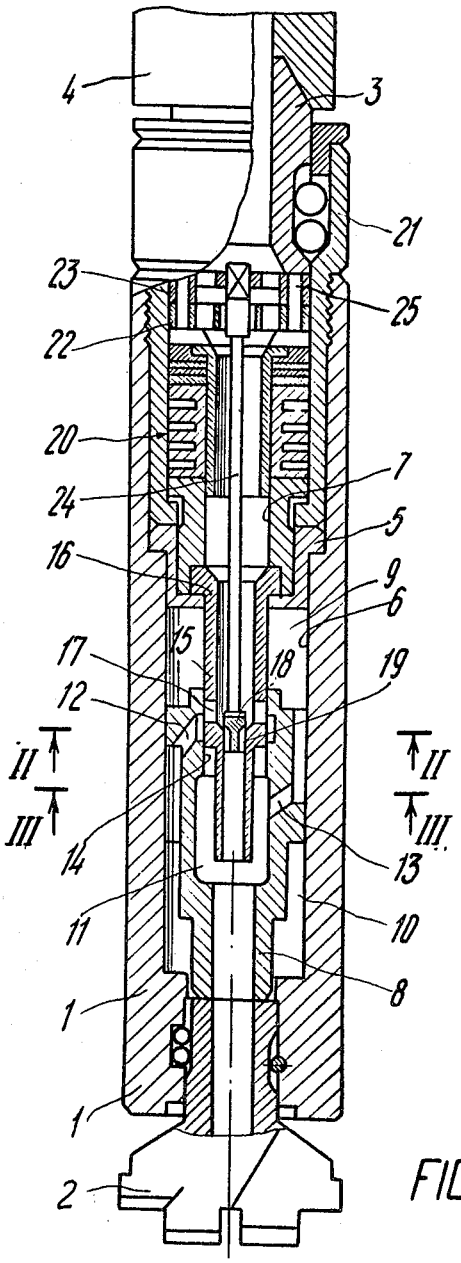
FIG. 1 is a longitudinal sectional view of a tool for rotary percussive drilling of boreholes, according to the invention.

A tool for cutting rotary percussive drilling of boreholes shown in FIG. 1 has a hollow casing 1 (FIG. 1) to one end of which is attached a bit 2 for breaking down rocks, the other end having a shank 3 for connecting to a drill rod 4 through which an axial force and a torque are transmitted to the tool.

The interior of the casing 1 is divided by means of a partition wall 5 into a working space 6 and a supply space 7 which is in permanent communication with a source of a fluid under pressure (not shown in the drawings). The working space 6 is divided by hammer piston 8 installed in the working space 6 for reciprocations into a workstroke chamber 9 and a return stroke chamber 10. During reciprocations the hammer piston 8 cooperates with the bit 2 to impart impact impulses thereto.

Figure 2:
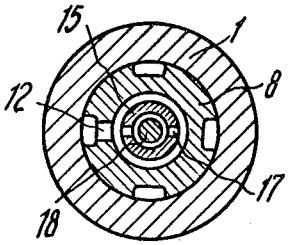
FIG. 2 is a cross sectional view taken along the line II—II in FIG. 1.
Figure 3:
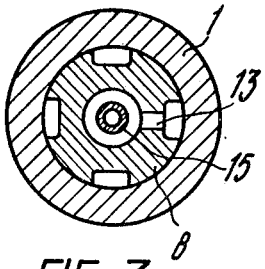
FIG. 3 is a cross sectional view taken along the line III—III in FIG. 1.

A distribution space 11 is provided in the body of the hammer piston 8, and distribution means are also provided therein which comprise a passage 12 (FIGS. 1 and 2) connecting the return stroke chamber 10 to the source of a fluid, via the supply space 7 (FIG. 1), and a passage 13 (FIGS. 1 and 3) connecting, via the supply space 7 (FIG. 1) and the distribution space 11, the workstroke chamber 9 to the source of a fluid under pressure for causing reciprocations of the hammer piston 8.

The body of the hammer piston 8 has a port 14 in which is received in a sealing relationship a pipe 15 having one end extending through an opening 16 of the partition wall 5 and the other end in permanent communication with atmosphere. For feeding a fluid under pressure from the feed space 7 to the workstroke and return stroke chambers 9 and 10, respectively, the pipe 15 (FIGS. 1, 2) has openings 17 alternately connectible through the passage 12 to the return stroke chamber 10 (FIG. 1) and through the distribution space 11 and the passage 13 (FIGS. 1 and 3) to the workstroke chamber 9 (FIG. 1) so as to provide for fluid supply from the feed space 7 to the working space 6.

To cause reciprocations of the hammer piston 8 at various rates or with varying kinetic energy of movement of the hammer piston 8 in the working space 6 between maximum and minimum values, a fluid under pressure is to be re-distributed between the working space 6 and atmosphere. This may be effected by using various controlled throttling means provided at any point, the control of such means being possible also in different ways.

In the tool herein described which is designed for cutting rotary percussive drilling of boreholes, the controlled throttling means comprises the pipe 15 and a slide valve member 18 movable relative to the pipe 15 and defining therewith a throttling orifice, the size of the orifice changing depending on the amount of the relative movement of the slide valve member 18. The slide valve 18 has in its outer surface passages 19 which are closed on the side of the supply space 7 and define together with the pipe the throttling orifice proper; and, when the slide valve member 18 moves relative to the pipe 15, it may take two limit positions so that in the first position the supply space 7 is in permanent communication with atmosphere and in the second position it is completely closed by the slide valve member 18 so as to provide for the full supply of a fluid to the workstroke chamber 9 and the return stroke chamber 10 of the hammer piston 8.

The controlled throttling means may be controlled by various methods, such as mechanically, electrically, magnetically and the like.

With the mechanical method of control means, a sensitive element may comprise mechanical elastic means, as well as electrical, magnetic and like sensors.

For obtaining an optimum performance of drilling in alternating hardness rocks, the control means should provide for establishing a relationship of the kinetic energy of the hammer piston versus hardness of the rocks being drilled.

In this particular embodiment of the invention the kinetic energy of the hammer piston is caused to vary by changing the supply of a fluid under pressure. A change in the supply of a fluid under pressure is caused by feeding a fluid admitted to the working space 6 through a throttling orifice, the size of the orifice being automatically controlled depending on hardness of the rocks being drilled. In this particular embodiment of the invention the size of the throttling orifice is controlled depending on the amount of the axial compression of elastic means coupled to the controlled throttling means.

The supply of a fluid under pressure is controlled between two limit positions of the throttling means (which is effected by setting the slide valve member 18 to a respective position) so that in the first position a partial supply of a fluid is provided to the working space 6 so as to provide for reciprocations of the hammer piston 8 only, without transmitting impact impulses to the bit 2. In the second position the supply of a fluid through the controlled throttling means is shut-off so as to provide for the full supply of a fluid to the workstroke chamber 9 and the return stroke chamber 10, respectively, for reciprocations of the hammer piston 8 with maximum kinetic energy.

The control means proper comprise elastic means 20 mechanically coupled to the slide valve member 18 of the controlled throttling means.

The elastic means may comprise various kinds of springs, such as coil springs, three-dimensional springs, plate springs and the like, and also materials having elastic properties may be used, such as rubber-based or other synthetic materials.

In this particular tool for drilling (FIG. 1) the elastic means are provided in the supply space 7 and are protected from the outside by a sleeve 21 which is provided for the installation of the control means in the hollow casing 1. The sleeve 21 rigidly coupled to the casing 1 bears with its inner end face against the partition wall 5, and the outer end face of the sleeve is coupled to the shank 3 in such a manner that the shank 3 is axially movable relative to the casing 1 and the sleeve 21 and is rigidly connected to the casing 1 for combined rotation.

The inner end face of the shank 3 is coupled to the elastic means by means of an adjustment nut 22 and a lock washer 23 which are coupled to the slide valve member 18 by means of a rod 24 and are designed for adjusting the size of the throttling orifice (the adjustment nut 22) and for fixing this size (lock washer 23). The position of the adjustment nut 22 with respect to the lock washer 23 is fixed by a pin 25.

Figure 4:
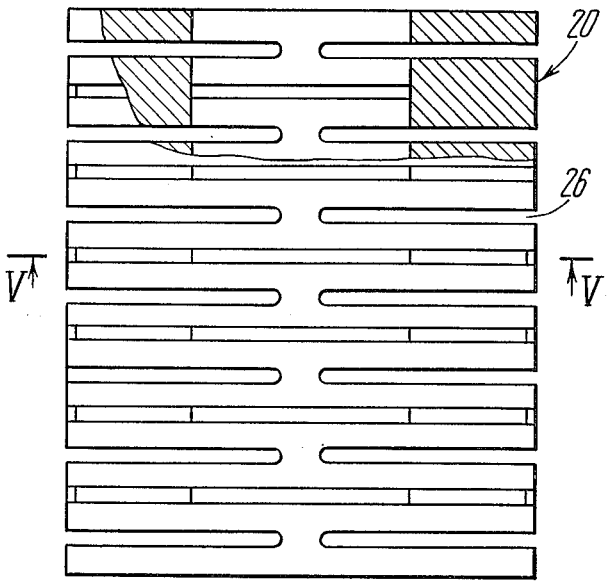
FIG. 4 shows an elastic means in the form of a cylindrical spring.
Figure 5:
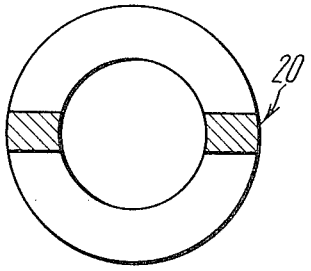
FIG. 5 is a view taken along the line V—V in FIG. 4.

The elastic means 20 (FIGS. 4 and 5) comprise a cylinder having in its body opposite transverse grooves 26 extending over its entire length (FIG. 4).

The grooves 26 alternate axially in mutually orthogonal planes. The grooves 26 are of a size such that the elastic means comprises a kind of a stack of flat plates interconnected in the central part. This arrangement of the elastic means provides for a sufficiently large change in its linear dimension for controlling the throttling means and enables the provision of an elastic structure of a small size withstanding high static loads and very reliable under dynamic loads.

The tool for cutting percussive rotary drilling of boreholes shown in FIG. 1 functions in the following manner.

A starting position shown in FIG. 1 is illustrated when there is no axial force transmitted from the drill rod 4 to the shank 3, and the supply space 7 communicates with atmosphere. A fluid from the supply space 7 is fed to atmosphere.

When an axial load is applied to the shank 3 and the bit 2 engages the rock, a reaction force is applied from the rock through the bit 2, hollow casing 1 and the sleeve 21 to the elastic means 20 so as to change the linear dimension of the elastic means 20. The adjustment nut 22 and the lock washer 23 which are coupled to the elastic means 20 are caused to move upon a change in the linear dimension thereof relative to the inner surface of the sleeve 21. The rod 24 coupled to the adjustment nut 22 at one end and to the slide valve member 18 at the other end is thus caused to move through the same linear distance as the adjustment nut 22 so as to cause the displacement of the slide valve member 18 inside the pipe 15, thereby causing a change in the size of the throttling orifice of the controlled throttling means.

A fluid from the supply space 7 is re-distributed depending on the size of the throttling orifice by the distribution means between the working space and atmosphere.

When the throttling orifice of the controlled throttling means, completely closed, a fluid under pressure is admitted through the openings 17 of the pipe 15 through the passage 12 to the return stroke chamber 10 of the hammer piston 8, when it is in the end of the stroke position and engages the bit 2, so as to increase the pressure in the return stroke chamber 10 to the rated pressure and to cause the hammer piston 8 to move toward the partition wall 5. The hammer piston 8 moves until the openings 17 are open into the distribution space 11. At that moment the workstroke chamber 9 permanently communicates with atmosphere through the passage 13 and the distribution space 11, until the openings 17 are open into the distribution space 11. When this happens, the connection of the workstroke chamber 9 to atmosphere is interrupted, the hammer piston 8 stops, and a fluid under pressure is admitted through the distribution space 11 and the passage 13 to the workstroke chamber 9. The pressure in the workstroke chamber 9 increases to its maximum so as to cause the hammer piston 8 to move in the opposite direction so that, when the hammer piston hits against the bit 2 at the end of the stroke position at maximum kinetic energy, an impact impulse is transmitted to the borehole bottom. The process is then repeated in the above-described sequence.

If the hardness of the rock encountered by the bit 2 changes, the force applied to the elastic means 20 also changes so that the linear dimension of the elastic means becomes different which results in a variation of the size of the throttling orifice of the controlled throttling means. A change in the side of the throttling orifice results in a re-distribution of a fluid under pressure between the working space 6 and atmosphere, thereby causing a change in the kinetic energy of the hammer piston during its reciprocations. The kinetic energy of the hammer piston on the 8 thereby varies depending on hardness of encountered rocks being drilled.

It should be kept in mind that the specific embodiment of the invention illustrated in the drawings and described above represents only a preferred embodiment of the invention. It will be understood by those skilled in the art that various modifications of the invention are possible as regards shape, size and arrangement of individual elements without departure from the spirit and scope of the invention.

We claim:

1. A tool for cutting percussive rotary drilling of boreholes, comprising: a hollow casing; a bit secured in said casing for axially moving relative thereto and connected to said casing for combined positive rotation; a partition wall dividing the interior of said hollow casing into a working space defined on the side of said bit and a supply space, an opening of said partition wall through which said working space and said supply space communicate with one another;

a source of a fluid under pressure in permanent communication with said supply space; a hammer piston installed in said working space for reciprocations and for cooperation with said bit for imparting impact impulses thereto, said hammer piston dividing said working space into a workstroke chamber and a return stroke chamber;

distribution means provided in said casing for alternately connecting said workstroke and return stroke chambers, respectively, via said supply space, to said source of a fluid under pressure for causing reciprocations of said hammer piston;

controlled throttling means in permanent communication with said distribution means, said throttling means being installed for setting said distributing means in two limit positions so that in the first position there is permanent communication of said supply space with atmosphere so as to provide for a partial supply of a fluid for reciprocations of said hammer piston at minimum kinetic energy and in the second position said throttling means are completely closed so as to provide for the full supply of a fluid to said workstroke and return stroke chambers through said distribution means for reciprocations of said hammer piston at maximum kinetic energy; and control means coupled to said bit and to said controlled throttling means for setting them to the first position when said bit encounters a soft rock and to the second position when said bit encounters a hard rock.

2. A tool for cutting percussive rotary drilling of boreholes according to claim 1, wherein said controlled throttling means are accommodated in said casing.

3. A tool for cutting percussive rotary drilling of boreholes according to claim 2, wherein a distribution space is defined in said hammer piston and is in permanent communication with said workstroke chamber; said controlled throttling means are in permanent communication with said distribution space so that in the first position they permanently connect said supply space to atmosphere and in the second position the throttling means are completely closed so as to provide for the full supply of a fluid to said workstroke and return stroke chambers through said distribution space; said controlled throttling means comprising a pipe which has one end received in said opening of the partition wall and another end extending in a sealing relationship through said port of the hammer piston into said distribution space so that the hammer piston is movable along said pipe; and a slide valve member which is installed in said pipe for moving relative thereto and which defines with the pipe a throttling orifice, the size of the throttling orifice changing depending on the amount of the relative movement of the slide valve member, said pipe having openings to alternately connect said return stroke chamber to the source of a fluid through said passages of the hammer piston during reciprocations of the hammer piston.

4. A tool for cutting percussive rotary drilling of boreholes according to claim 3, comprising distribution means in the form of passages provided in said hammer piston, said passages connecting said distribution space to said workstroke chamber and said return stroke chamber to said supply space; a port of said hammer piston, in which terminate said passages, connecting said return stroke chamber to said supply space.

5. A tool for cutting percussive rotary drilling of boreholes according to claim 4, wherein said throttling orifice is defined by passages made in the outer surface of said slide valve member and closed on the side of said supply space.

6. A tool for cutting percussive rotary drilling of boreholes according to claim 1, wherein said control means comprise elastic means coupled to said controlled throttling means for controlling them depending on an axial compression of the elastic means.

7. A tool for cutting percussive rotary drilling according to claim 6, wherein the elastic means are installed in said supply space and are coupled to said controlled throttling means by means of a rod installed in said pipe.

8. A tool for cutting percussive rotary drilling according to claim 7, wherein the elastic means comprise a cylinder having in its body opposite transverse grooves extending over the entire length thereof.

* * * * *